US010553386B2

(12) United States Patent
von zur Muehlen et al.

(10) Patent No.: US 10,553,386 B2
(45) Date of Patent: Feb. 4, 2020

(54) HIGH VOLTAGE, REINFORCED IN-LINE FUSE ASSEMBLY, SYSTEMS, AND METHODS OF MANUFACTURE

(71) Applicant: EATON INTELLIGENT POWER LIMITED, Dublin OT (IE)

(72) Inventors: Patrick A. von zur Muehlen, Wildwood, MO (US); Michael C. Henricks, Ballwin, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 415 days.

(21) Appl. No.: 14/081,331

(22) Filed: Nov. 15, 2013

(65) Prior Publication Data

US 2015/0137934 A1 May 21, 2015

(51) Int. Cl.
*H01H 69/02* (2006.01)
*H01H 85/38* (2006.01)
*H01H 85/34* (2006.01)

(52) U.S. Cl.
CPC ..... *H01H 85/38* (2013.01); *H01H 69/02* (2013.01); *H01H 85/34* (2013.01); *H01H 2085/388* (2013.01)

(58) Field of Classification Search
CPC .... H01H 85/042; H01H 85/18; H01H 85/185; H01H 85/34; H01H 85/38; H01H 85/43; H01H 2085/381; H01H 2085/388; H01H 69/02
USPC ..... 337/273
See application file for complete search history.

(56) References Cited

U.S. PATENT DOCUMENTS 3,848,215 A * 11/1974 Kozacka ..... H01H 85/165 337/186
4,734,059 A * 3/1988 Melugin ..... H01H 85/201 337/201
4,909,761 A * 3/1990 Muguira ..... H01H 85/201 337/201
5,018,991 A * 5/1991 Katz ..... H01H 85/201 337/205
5,137,478 A * 8/1992 Graf ..... H01R 4/723 174/84 R
5,648,749 A * 7/1997 Lin ..... H01H 85/201 337/192
5,714,923 A * 2/1998 Shea ..... H01H 85/055 337/142
5,726,851 A 3/1998 Knapp
(Continued)

FOREIGN PATENT DOCUMENTS

DE 102011102624 A1 11/2012
EP 0047592 A2 3/1982
(Continued)

OTHER PUBLICATIONS

10×38mm Photovoltaic Fuse Links for Solar Panel Applications—1A to 20A, 1000Vdc Solar PV Series; Cooper Bussmann Data Sheet 720110; May 21, 2013; pp. 1-3.
(Continued)

*Primary Examiner* — Jacob R Crum
(74) *Attorney, Agent, or Firm* — Armstrong Teasdale LLP

(57) ABSTRACT

Fuse assemblies, systems and methods of manufacture include reinforcement materials and arc absorbent materials to provide overcurrent protection for 1500 VDC power systems without enlarging the body of the fuse.

25 Claims, 5 Drawing Sheets

(56) References Cited

U.S. PATENT DOCUMENTS

| | | | | |
|---|---|---|---|---|
| 5,888,098 | A * | 3/1999 | Cheng | H01H 85/201 439/620.28 |
| 8,454,390 | B2 | 6/2013 | Darr et al. | |
| 2005/0141164 | A1* | 6/2005 | Bender | H01H 69/022 361/104 |
| 2010/0207716 | A1 | 8/2010 | Yen | |
| 2012/0295456 | A1* | 11/2012 | Severac | H01R 9/2408 439/136 |
| 2012/0309232 | A1 | 12/2012 | Darr et al. | |

FOREIGN PATENT DOCUMENTS

| | | | |
|---|---|---|---|
| JP | 1983160452 | | 10/1983 |
| JP | 1985236430 | | 11/1986 |
| JP | 1993214305 | A | 8/1993 |
| JP | 199751618 | | 2/1997 |
| JP | 2000340094 | | 12/2000 |
| JP | 2002056768 | A | 2/2002 |
| JP | 2010239045 | A | 10/2010 |
| JP | 2010257623 | A | 11/2010 |

OTHER PUBLICATIONS

Dunbar-PHWT-FR 3:1 Shrink Ratio, Flexible, Semi-Rigid, Heavy Wall, Flame Retardant, Adhesive-Lined Polyolefin Tubing; Dunbar Associates; Jun. 2009; 2 pages.

Extended European Search Report for Application No. 14193134.5, Apr. 7, 2015, 9 pages.

English Translation of Notice of Reasons for Rejection for Japanese Application No. 2014-229548, Aug. 28, 2018, 3 pages.

* cited by examiner

HIGH VOLTAGE, REINFORCED IN-LINE FUSE ASSEMBLY, SYSTEMS, AND METHODS OF MANUFACTURE

BACKGROUND OF THE INVENTION

The field of the invention relates generally to electrical circuit protection fuses, and more specifically to compact fuse assemblies for high voltage, direct current (DC) electrical power distribution systems.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage.

Certain types of fuse assemblies present ongoing challenges to fuse manufacturers. For example, fuse assemblies are now desired for direct current (DC) power system applications operating at higher voltages than conventional DC power systems. Existing electrical fuse assemblies are inadequate for the higher voltage DC power systems now proposed, and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
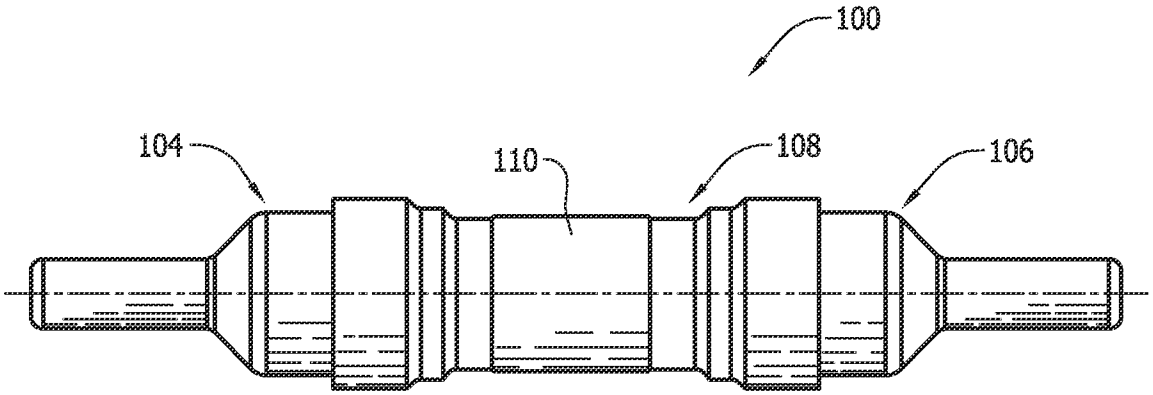
FIG. 1 is a side elevational view of a first exemplary embodiment of an in-line fuse assembly.

As further introduction to the inventive concepts described herein, accommodating higher operating voltages for electrical fuse assemblies can be anything but simple. Achieving higher voltage ratings, for example, is not simply achieved by scaling some or all components of a fuse assembly. In particular, the electrical energy associated with electrical arcing conditions as the fuse element operates, sometimes referred to as arc flash energy, is much more severe at higher operating voltages than at lower voltages. This is especially so when the operating voltage is increased substantially.

Electrical power systems operable at 1500 VDC are now being proposed for certain applications, including but not limited to photovoltaic power systems. Of course, circuit protectors such as fuses are desired for use with such 1500 VDC power systems, but the potential arc flash energy associated with such a high voltage DC application renders existing electrical fuse assemblies disadvantaged for use in a 1500 VDC power system. While fuses are known having a rating as high as 1000 VDC, the jump to 1500 VDC power systems is daunting. A 50% increase in operating voltage from 1000 VDC power systems to 1500 VDC provides a dramatic increase in potential arc flash energy when a fuse operates under a 1500 VDC load, and renders conventional fuses, even those rated for 1000 VDC applications, unsuitable for 1500 VDC applications.

A potential solution would be to design a new fuse specifically for use in a 1500 VDC system. In a well-designed fuse for such use, the arc flash energy associated with high voltage DC power systems could be safely managed, but likely only at considerable cost.

Conventionally, increased voltage ratings for DC power applications have been achieved using more expensive materials to fabricate the fuse elements, implementing additional inspection and quality control procedures into manufacturing processes, adopting specific care in handing procedures, and/or adopt larger body fuses which provide additional design margin. Larger bodied fuses, in turn, facilitate more arc absorbing or arc extinguishing filler to absorb are energy. In a high volume, competitive environment, however, the introduction of newer, more expensive fuses is a difficult proposition.

Introducing larger-bodied fuses presents other problems too that are of practical concern to those in the fuse industry. In the example discussed, namely providing a fuse assembly for a 1500 VDC power system, a larger-bodied fuse would be incompatible with existing in-line fuse holder components and accessories that may be desirable in a photovoltaic power system or perhaps other types of fuse holder components or accessories in other electrical power system applications. Larger-bodied fuses may therefor necessitate larger in-line fuse assemblies and fuse holders that must be designed and/or purchased at further expense to fuse manufactures, providers and users.

Also, and following a general trend in the industry, smaller fuse asssemblies are generally preferred over larger ones. Providing higher fuse protection ratings in smaller physical packages, or in some cases providing higher fuse protection ratings in physical packages of the same size as existing fuses, is much more attractive to end users than larger bodied fuses having larger physical packages. The larger physical packages require more space to install and use, and in today's competitive environment increased space requirements imposes still other costs to costs to electrical power system providers.

Considering the collective costs of providing new, larger fuses for 1500 VDC applications, the costs of providing new fuse holders and accessories, and the costs of increased space requirements for larger fuses and accessories, providing custom designed fuse assemblies by enlarging the fuse package to render it more capable of performing such an operating environment is an unattractive proposition. The costs of newer, more expensive fuses and newer, more expensive fuse holders and accessories accumulate rapidly for large power systems having a high number of fuses. Cost and size constraints for existing power distribution systems can even be an impediment to adoption of higher voltage power distribution systems.

Exemplary embodiments of fuse assemblies are described hereinbelow that address these and other problems in the art.

Fuse assemblies are provided for high voltage DC power systems without providing custom designed, more expensive and larger-bodied fuses. The fuse assemblies are similar in size to existing fuse packages, and compatibility with existing fuse holders and accessories is preserved. No change in tooling or assembly methods for customers who wish to adopt higher voltage power systems is required. Reliable fuse operation for high voltage power systems is provided at relatively low cost.

The above and other benefits are achieved at least in part by providing a reinforced fuse assembly with enhanced arc flash energy containment capability. Reinforcement material is applied to a fuse that enhances structural strength of the fuse package, such that even if a body of the fuse were to rupture or fail at one or more locations due to severe arc flash energy release, the arc flash energy will still be safely contained interior to the reinforcement material. As such, overcurrent protection for a higher voltage DC power system (e.g., 1500 VDC) can be effectively provided in a smaller package size at relatively low cost without having to custom design new and larger fuse components, including but not limited to the fuse body. Method aspects will be in part apparent and in part explicitly discussed in the description below.

While the inventive concepts are described in the context of 1500 VDC photovoltaic power systems, the concepts herein are not necessarily limited to photovoltaic systems, nor are they necessarily limited to 1500 VDC applications. The following description is provided for the sake of illustrating rather than limitation, and other power systems (e.g., non-photovoltaic power systems) operating at different voltages higher and lower than 1500 VDC may benefit from the concepts described herein.

Figure 2:
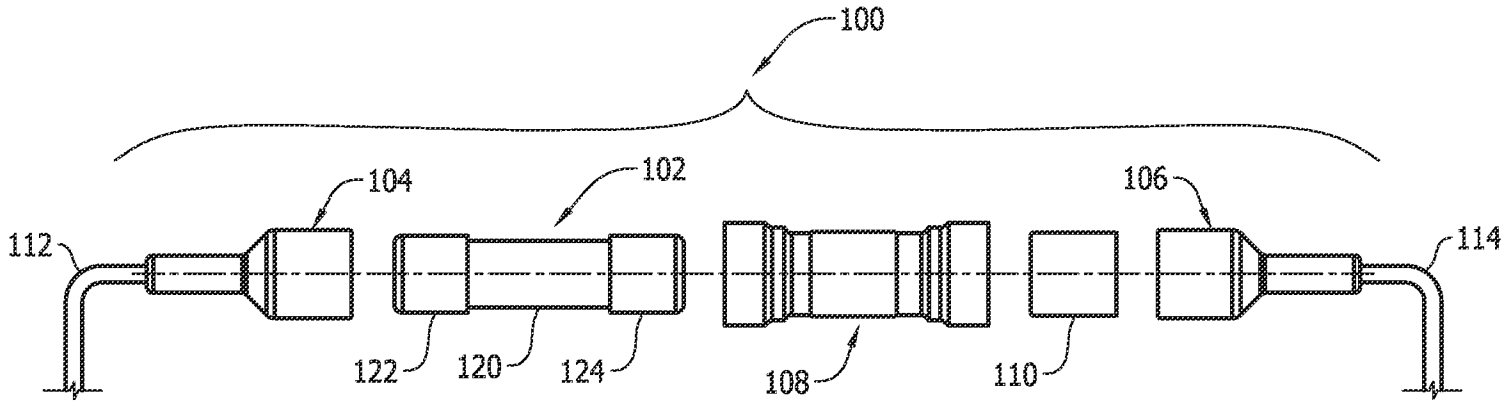
FIG. 2 is an exploded assembly view of the assembly shown in FIG. 1.
Figure 3:
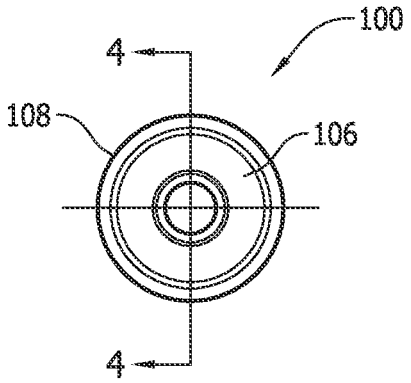
FIG. 3 is an end view of the assembly shown in FIG. 1.
Figure 4:
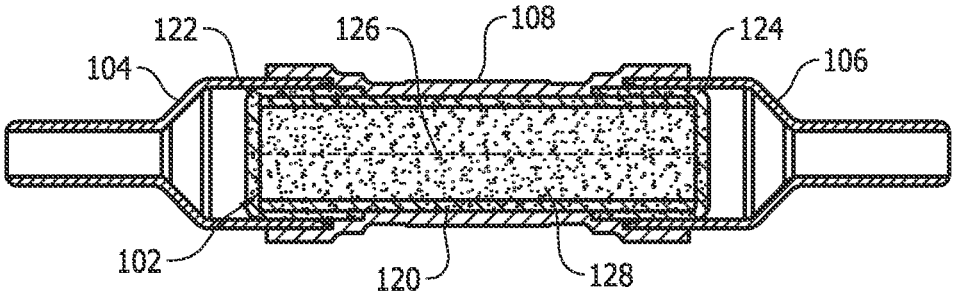
FIG. 4 is a sectional view of the assembly taken along line 4-4 in FIG. 3.

Referring now to the drawings, FIGS. 1-4 illustrate various views of a first exemplary embodiment of an in-line fuse assembly 100. FIG. 1 is a side assembly view of the assembly 100, FIG. 2 is an exploded assembly view of the assembly 100, FIG. 3 is an end view of the assembly 100, and FIG. 4 is a sectional view of the assembly 100 taken along line 4-4 in FIG. 3. As seen in these Figures, the assembly 100 includes a fuse 102 (FIGS. 2 and 4), circuit connector terminals 104 and 106, a reinforcing sleeve element 108, and a label 110.

As one example, the fuse 102 may be 10×38 mm photovoltaic fuse, Catalog number PV-XXA10F solar fuse, available from Bussmann by Eaton, St Louis Mo. (formerly known as Cooper Bussmann), Bussmann Datasheet #720110. The fuse 102 in this example, may have a current rating of 1-20 A and a voltage rating of 1000 VDC, and is sometimes referred to herein as a high voltage, low current fuse. While an exemplary fuse 102 having exemplary ratings is identified, other fuses may likewise be used in other embodiments.

The fuse 102 generally includes an elongated, nonconductive fuse body 120 and conductive fuse terminals 122, 124 coupled to opposing ends of the body 120. The body 120 in the example shown is generally cylindrical and may be fabricated from a nonconductive material known in the art, including but not limited to ceramic. Other non-cylindrical shapes and configurations of the fuse body are possible, however, in other embodiments. The terminals 122, 124 may be recognized as ferrule terminals, although it is recognized that in other embodiments other types of fuse terminals may be provided on the fuse 102.

A fuse element 126 (shown in phantom in FIG. 4) extends internal to the fuse body 120 and between the terminals 122, 124. The fuse element 126 defines a circuit path between the fuse terminals 122 and 124 so that when electrical current flowing through the fuse 102 exceeds a predetermined limit, the fuse element 126 melts, disintegrates, or otherwise structurally fails and opens the circuit through the fuse element 126 through the fuse 102. A variety of different types of fuse elements, fuse links, or fuse element or fusible link assemblies are known and may be utilized in the fuse 102. More than one fuse element or fusible link may be provided as desired in the fuse 102. An arc absorbing media 128 such as silica sand, fills the interior of the fuse body 102 in a known manner. A variety of arc absorbing or arc extinguishing materials are known and may likewise be used.

The circuit connecting terminals 104, 106 in the exemplary embodiment shown in the Figures are in-line wire crimp terminals such as A2650 crimp terminal fittings fabricated from brass or another conductive material. In one non-limiting example, the circuit connector terminals 104, 106 are configured for crimping, using a suitable crimping tool (e.g., Sta-Kon® Comfort Crimp® Compression Tool, Model ERG4002 by Thomas & Betts), to connect line and load-side wires 112, 114 of an electrical circuit to the connector terminals 104, 106. While specific connector terminals 104, 106 are described, it is understood that other connector terminals may be provided having other features and configurations without departing from the scope of the present invention. The wires 112, 114 may be 10-12AWG stranded solar PV wire in one example, or may alternatively be other types of wire in other embodiments.

In the assembly 100, the connector terminals 104, 106 are separately provided elements from the fuse 102, and are secured to the fuse terminals 122, 124 via a friction fit. The reinforcing sleeve element 108 is then applied over the exterior of the fuse body 102 and portions of the connector terminals 104, 106.

In one example, the reinforcing sleeve element 108 is 2A3185 adhesive heat shrink R/C (YDTU2.E157227), Catalog. No. EPS-300, ½", Black adhesive-lined, heat shrink tubing available from the 3M Company of St., Paul, Minn. The reinforcing sleeve element 108 may be applied in a known manner and provides structural reinforcement for the fuse body 120 to better withstand increased arc flash severity when the fuse element 126 operates when under a 1500 VDC load. Especially when the fuse body 120 is fabricated from ceramic, cracks or ruptures may develop when the fuse operates under load at a 1500 VDC load. Recognizing that the fuse 102 in the example discussed has a rating of 1000 VDC at least in part because of the construction of the body 120 and its ability to withstand arc flash energy at 1000 VDC or below, the additional structural strength of the reinforcing sleeve element 108 allows arc flash energy under a 1500 VDC load to be safely contained. The reinforcing sleeve element 108 and its dimensions is accordingly selected in view of the potential arc flash energy and the ability of the fuse body 102 to withstand it.

The adhesive lining of the reinforcing sleeve element 108 provides additional structural strength as well as additional sealing of the ferrule/body joints of the fuse 102. If electrical arcing occurs at a location closer to the fuse terminals 122, 124, and specifically in the vicinity of the fuse ferrule/body seal of the fuse 102, electrical arcing and arc flash energy may otherwise cause rupture of the seal. Again considering that the fuse 102 in the example described was designed with a 1000 VDC rating, the ferrule/body joints of the fuse 102 may be susceptible to rupture when the fuse element 126 operates under higher load at 1500 VDC. With the reinforcing sleeve element 108, the fuse having a 1000 VDC rating may otherwise capably perform in a 1500 VDC power system. In other words, the reinforcing sleeve element 108 including the adhesive effectively allows the fuse 102 designed to provide a 1000 VDC rating to effectively function as a 1500 VDC rated fuse assembly.

Considering the exemplary fuse 102 described above, a 1500 VDC rated fuse assembly is provided in a physical package slightly larger than a convention 10×38 mm fuse package. A 50% increase in the voltage rating of the fuse 102 (e.g., 1000 VDC) to the voltage rating of the assembly 100 (e.g., 1500 VDC) is provided in a substantially similar package size. Because the package size change of the assembly 100 versus the fuse 102 alone is slight, the assembly 100 is operable with existing fuse holders, wiring harnesses, and accessories.

While the adhesive lined reinforcing sleeve element 108 is beneficial for the reasons noted above, and also simplifies assembly steps as the fuse assembly 100 is manufactured, the adhesive could in some embodiments be supplied separately from the reinforcing sleeve element 108. In other contemplated embodiments, the adhesive may be considered optional and may be omitted. Also, while specific reinforcement material has been identified for the element 108, it is exemplary only. Other reinforcing materials known in the art may be used, including but not limited to different types of heat shrink material. Non-heat shrink reinforcement materials may also be utilized to achieve at least some of the benefits described to some extent.

The fuse label 110 is applied to the outer surface of the reinforcing sleeve element 108 in a known manner and is provided with text, graphics or indicia conveying information to the user regarding the ratings of the assembly 100. The label 110 may also be color coded in whole or in part to identify the type of assembly 100 to a user tasked with installing or replacing the assembly 100 in an electrical power system. For example, the fuse label 110 may be provided with a color such as yellow, to be matched with a compatible fuse holder, wiring harness, or other accessory used in combination with the assembly 100 also marked with the same color. As such, matching color coding may convey that the fuse assembly 100 and the accessory are compatible. Other colors may be used on incompatible accessories or other types of fuse assemblies. In such a manner, confusion regarding compatibility or incompatibility of fuse assemblies and accessories may be avoided in the field. As one illustration, a photovoltaic fuse assembly 100 having a first color (e.g., yellow) can be distinguished from a non-photovoltaic fuse assembly having a label with a second color (e.g., red), and a photovoltaic fuse accessory can be distinguished from a non-photovoltaic fuse accessory via similar color coding provided on the accessories. Mismatching of incompatible fuse assemblies and accessories is therefore easily avoided by installers or maintenance personnel for an electrical power system.

The fuse assembly 100 is beneficial in at least the following aspects. The assembly 100 meets new and higher voltage requirements for 1500 VDC power distributions by virtue of the reinforcing sleeve element 108, without having to custom design and tool a new fuse having larger components. The fuse assembly 100 may be used with existing accessories such as fuse holders and the like, without having to custom design and tool new accessories. Power distribution system operators may therefore adopt higher voltage power distribution systems with minimal increased costs and without having to use fuse assemblies having larger package sizes.

Figure 5:
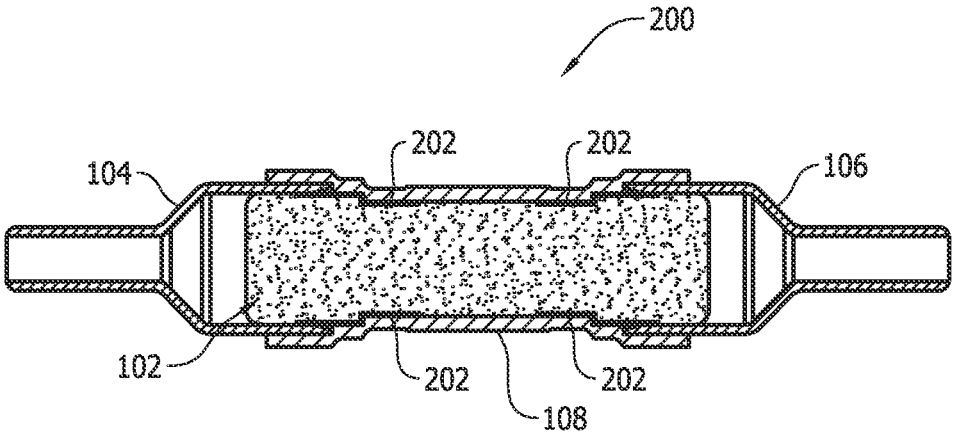
FIG. 5 is a sectional view similar to FIG. 4 but showing a second exemplary embodiment of an in-line fuse assembly.

FIG. 5 is a sectional view of a second embodiment of a fuse assembly 200 similar to the assembly 100 described above, but further including additional arc absorbing material 202 placed between the adhesive lined reinforcing element 108 and the fuse body 122 to provide further enhancement of the are flash suppression in case of energy leaking or primary barrier (e.g., ceramic) failure of the fuse body 122. The additional arc absorbing material may include silicone, TEFLON® synthetic resinous fluorine-containing polymer material fabricated into tape, or other suitable elements known in the art.

By virtue of the additional arc absorbing material 202 provided on the exterior of the fuse body 120 and portions of the wire connector terminals 104 and 106, additional protection against a release of arc flash energy is provided at the sealed joints of the fuse ferrules and body of the fuse 102. While in the example of FIG. 5, the additional arc absorbing material 202 is provided only proximate the ferrule/body joints of the fuse 102, and thus incompletely covers the exterior of the fuse body 120 and also incompletely covers the exterior of the connecting terminals 104 and 106, the additional arc absorbing material 202 could be provided to cover the entirety of the fuse body 120 and/or to more completely cover the exterior of the connecting terminals 104, 106 if desired.

Because of the additional arc absorbing material 202, the fuse assembly 200 may more capably handle arc flash energy occurring under a 1500 VDC load than the assembly 100 described above. The assembly 200 including the additional arc absorbing material 202 may likewise provide an effective voltage rating of more than 1500 VDC for the assembly 200.

Except as noted, the construction of the assembly 200 is similar to the construction of the assembly 100, and the assembly 200 provides similar advantages to the assembly 100.

Figure 6:
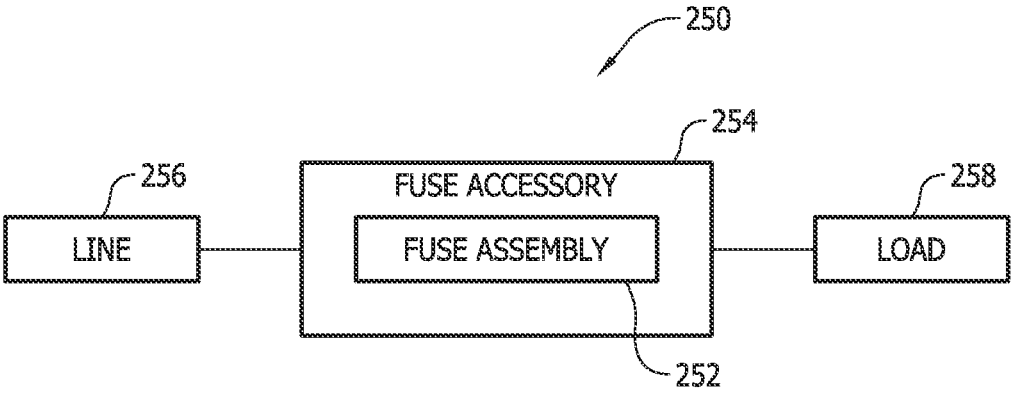
FIG. 6 is a schematic block diagram of a fuse system including an in-line fuse assembly such as those shown in FIGS. 1-5.

FIG. 6 schematically illustrates a fuse system 250 including a fuse assembly 252 that may be either of the fuse assemblies 100 or 200 described above, and a fuse accessory 254 accepting the fuse assembly 252. The fuse accessory 254 may be, for example, a fuse holder or a wiring harness in contemplated embodiments. The accessory 254 completes an electrical connection between line side circuitry 256 and load side circuitry 258 through the fuse assembly 252. The fuse assembly 252 and the accessory 254 may be color coded as described above to ensure compatibility in a convenient and user friendly manner. The line and load circuitry 256 and 258 may define a photovoltaic power distribution system operating at about 1500 VDC. The fuse assembly 252 provides overcurrent protection to the load side circuitry 258, and once the fuse has opened, the fuse assembly 252 is replaced with a replacement fuse assembly to restore the full operation of the load side circuitry 258. As described above, when the fuse assemblies 100 or 200 are utilized as the fuse assembly 252, effective overcurrent protection may be provided in a 1500 VDC power system using a fuse rated at 1000 VDC.

Figure 7:
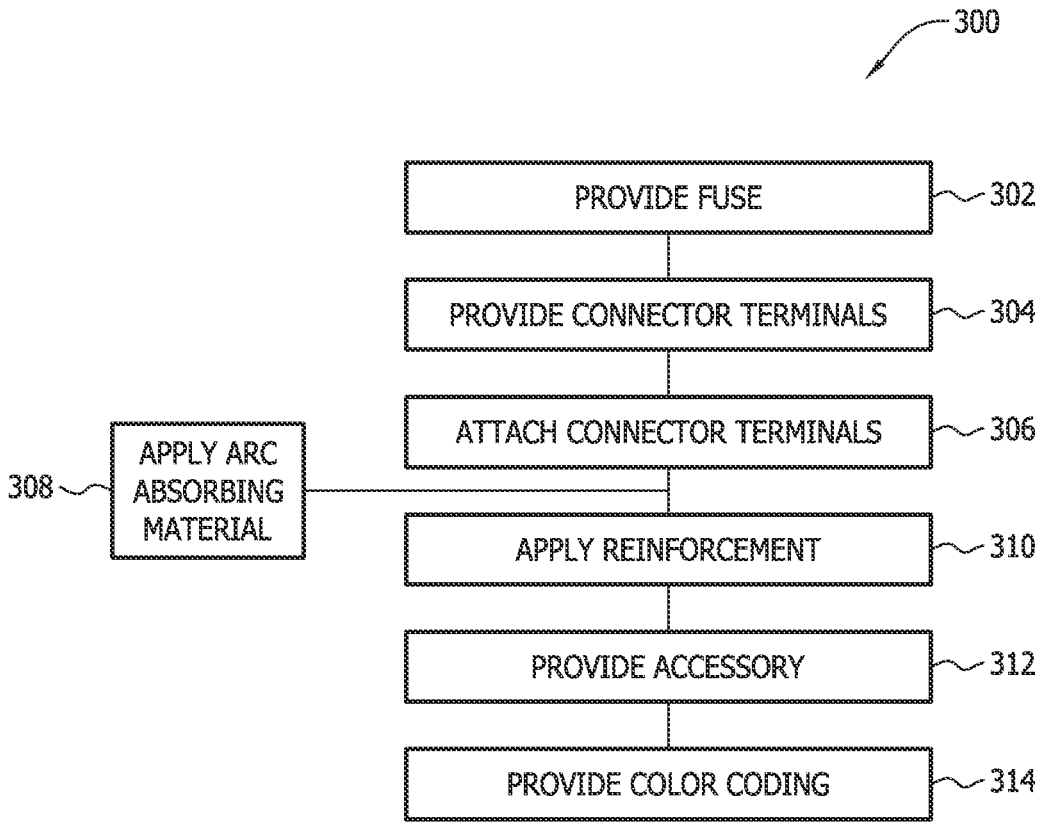
FIG. 7 is an exemplary flowchart of a method for fabricating the fuse assemblies shown in FIGS. 1-5 and the fuse system shown in FIG. 6.

FIG. 7 is an exemplary flowchart of a method 300 for fabricating the exemplary fuse assemblies and fuse system described above. At step 302, the fuse is provided such as the fuse 102 including the body 120, the fuse element 126 extending interior to the body, and first and second fuse terminal elements 122, 124 on the respective opposing ends of the fuse body 120 and establishing a circuit path with the fuse element 126. The electrical fuse provided may have a voltage rating of about 1000 VDC in contemplated embodiments, and may be a photovoltaic fuse. In other embodiments, non-photovoltaic fuses and other fuse ratings may likewise be utilized.

At step 304, connector terminals such the terminals 104 and 106 are provided. At step 306 the connector terminals 104, 106 are attached to the respective first and second terminal elements of the fuse 102. As described above the attachment may be accomplished by friction fit or other attachment techniques known in the art.

At step 308, an arc absorbent material such as the material 202 described above is optionally applied to the exterior of the fuse 102 at desired locations, including but not limited to the fuse ferrule and body joints.

At step 310, the fuse body, and also an arc absorbent material applied at step 308, is covered with a reinforcement material such as the material 108 described above. As described above, the reinforcement material applied at step 310 contains arc energy when the fuse element opens to break the circuit path when the body of the fuse has ruptured under an electrical load at least about 1500 VDC, even though the fuse 102 described in the assembly, on its own, has a voltage rating of 1000 VDC.

At step 312, an accessory is also provided. The accessory may be a fuse holder, a wiring harness, or another accessory known in the art. At step 314, color coding may be applied to the fuse assembly and to the accessory for the convenience of an end user. The color coding may be applied using adhesive labels and the like, or may be applied using other techniques known in the art.

The benefits and advantages of the invention are now believed to have been amply illustrated in relation to the exemplary embodiments disclosed.

An embodiment of an electrical fuse assembly has been disclosed including: an electrical fuse comprising a fuse body, first and second fuse terminal elements coupled to the fuse body, and a fuse element establishing a circuit path between the first and second fuse terminals, the fuse configured to provide a first direct current voltage rating; and a reinforcement material covering at least the fuse body configured to contain arc flash energy if the fuse body fails, thereby effectively increasing the direct current voltage rating to a second voltage rating greater than the first voltage rating.

Optionally, the assembly may also include first and second connector terminals attached to the respective first and second fuse terminal elements. The first and second connector terminals may be wire crimp terminals, and the reinforcement material may also cover at least a portion of the first and second connector terminals.

As further options, the fuse may be a cylindrical, photovoltaic fuse. At least one of the first and second fuse terminal elements may be a ferrule. The fuse body may be fabricated from ceramic. The first voltage rating may be about 1000 VDC, and wherein the second voltage rating is about 1500 VDC.

The assembly may optionally include an arc absorbing material extending between the reinforcement material and the fuse body. The arc absorbing material may be one of silicone and resinous fluorine-containing polymer material tape.

The reinforcement material may optionally be a heat shrink material, and the heat shrink material may include an adhesive.

The assembly may also optionally include a label, with the label being color coded to identify a compatible fuse accessory. The compatible fuse accessory may be at least one of a fuse holder and a wiring harness.

Another embodiment of an electrical fuse assembly has been disclosed. The assembly includes: an electrical fuse comprising a fuse body having opposing ends, first and second fuse terminals elements on the respective opposing ends of the fuse body, and a fuse element establishing a circuit path between the first and second fuse terminal element, wherein the electrical fuse has a voltage rating of at least about 1000V; first and second in-line wire crimp connectors attached to the respective first and second fuse terminal elements; and a reinforcement material covering the fuse body, wherein the reinforcement material contains arc energy when the fuse element opens to break the circuit path when the body of the fuse has ruptured under a load of at least about 1500 VDC.

Optionally, the first and second in-line connectors are friction fit to the first and second fuse terminal elements. The fuse may be a photovoltaic fuse, and the fuse body may be fabricated from ceramic. The fuse body may be cylindrical.

The assembly may further include an arc absorbing material extending between the reinforcement material and the body. The arc absorbing material may be one of silicone and resinous fluorine-containing polymer material tape.

The reinforcement material may be a heat shrink material, and the heat shrink material may be an adhesive lined heat shrink sleeve material.

The assembly may also include a label, the label being color coded to identify a compatible fuse accessory. The compatible fuse accessory may include at least one of a fuse holder and a wiring harness.

An exemplary method has been disclosed of manufacturing an in-line fuse assembly including an electrical fuse having a body having opposing ends, a fuse element extending interior to the body, and first and second fuse terminal elements on the respective opposing ends of the fuse body and establishing a circuit path with the fuse element. The method includes: attaching first and second in-line wire connectors to the respective first and second terminal elements of the fuse; and covering the body of the electrical fuse with a reinforcement material, whereby the reinforcement material contains arc energy when the fuse element opens to break the circuit path when the body of the fuse has ruptured under an electrical load at least about 1500 VDC.

Optionally, attaching the first and second in-line connectors may include friction fitting the first and second in-line connectors to the first and second terminal elements of the fuse. The fuse may be a photovoltaic fuse, and the body may be fabricated from ceramic.

The method may include extending an arc absorbing material between the reinforcement material and the body. Extending an arc absorbing material may include extending one of silicone and resinous fluorine-containing polymer material tape.

Covering the body of the electrical fuse with a reinforcement material may include applying a heat shrink material to the body. Applying a heat shrink material to the body may include applying an adhesive heat shrink material.

The method may also include applying a color coding to the fuse assembly. The method may also include providing a fuse accessory, and color coding the fuse accessory to match the fuse assembly.

An embodiment of an electrical fuse system has also been disclosed including: a fuse assembly including a low overcurrent protection fuse and a reinforcement material applied to the fuse and configured to provide a fuse assembly rating of at least 1500 VDC; and an accessory accepting the fuse assembly.

Optionally, the fuse may be a photovoltaic fuse having a rating of 1000 VDC. The fuse reinforcing material may include a heat shrink reinforcing element. The fuse assembly may include an arc absorbing material applied external to the fuse and extending internal to the reinforcement material. The fuse assembly and the accessory may be color coded. The fuse assembly may defines an in-line fuse assembly. The fuse may have a current rating of 1 to 20 Amps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compact high voltage electrical fuse assembly for a high voltage, direct current electrical power distribution system, the compact high voltage electrical fuse assembly comprising:

an in-line electrical fuse assembly comprising:

an electrical fuse designed to provide a predetermined direct current voltage rating, the electrical fuse comprising:

a cylindrical fuse body having first and second ends opposing one another;

a first ferrule terminal coupled to the first end of the cylindrical fuse body;

a second ferrule terminal coupled to the second end of the cylindrical fuse body;

a fuse element establishing a circuit path inside the cylindrical fuse body between the first ferrule terminal and the second ferrule terminal;

a first in-line wire crimp terminal coupled to an exterior of the first ferrule terminal;

a second in-line wire crimp terminal coupled to an exterior of the second ferrule terminal; and a structural reinforcement material applied to and conforming with an exterior shape of the in-line electrical fuse assembly, the structural reinforcement material being sufficient to contain arc flash energy and prevent release of arc flash energy when the fuse element opens under a direct current load at a voltage 50% greater than the predetermined direct current voltage rating, and the structural reinforcement material:

entirely covering and structurally reinforcing an exterior of the cylindrical fuse body;

entirely covering and structurally reinforcing any exposed exterior of each of the first and second ferrule terminals that are not already covered by the first or second in-line wire crimp terminal; and incompletely covering and structurally reinforcing only a minor portion of an exterior of each respective one of the first and second in-line wire crimp terminals.

2. The compact high voltage electrical fuse assembly of claim 1, wherein the electrical fuse is provided in a 10×38 mm fuse package.

3. The compact high voltage electrical fuse assembly of claim 1, wherein the predetermined direct current voltage rating of the electrical fuse is about 1000 VDC.

4. The compact high voltage electrical fuse assembly of claim 1, wherein the cylindrical fuse body is fabricated from ceramic.

5. The compact high voltage electrical fuse assembly of claim 1, further comprising an arc absorbing material extending in surface contact with the reinforcement material, in surface contact with the cylindrical fuse body, and in surface contact with a portion of each of the first ferrule terminal and the second ferrule terminal;

wherein the structural reinforcement material covers the arc absorbing material.

6. The compact high voltage electrical fuse assembly of claim 5, wherein the arc absorbing material is one of silicone or resinous fluorine-containing polymer material tape.

7. The compact high voltage electrical fuse assembly of claim 1, wherein the structural reinforcement material is applied as a sleeve of heat shrink material.

8. The compact high voltage electrical fuse assembly of claim 7, wherein the heat shrink material is adhered to the in-line electrical fuse assembly.

9. The compact high voltage electrical fuse assembly of claim 7, further comprising a label applied to an exterior of the structural reinforcement material, the label being color coded to identify a compatible fuse accessory.

10. The compact high voltage electrical fuse assembly of claim 9, wherein the compatible fuse accessory is a fuse holder or a wiring harness.

11. A method of manufacturing a compact high voltage electrical fuse assembly including an electrical fuse having a predetermined direct current voltage rating and including a cylindrical fuse body having opposing ends, a fuse element extending interior to the cylindrical fuse body, and first and second ferrule terminal elements on the respective opposing ends of the cylindrical fuse body and establishing a circuit path through the fuse element, the method comprising:

attaching first and second in-line wire crimp connectors to the respective first and second ferrule terminal elements; and entirely covering an exterior of the cylindrical fuse body and any exterior portion of the first and second ferrule terminal elements that are not covered by the first or second in-line wire crimp connectors with a structural reinforcement material conforming to the shape of the cylindrical fuse body and the first and second ferrule terminal elements, while incompletely covering exterior portions of the first and second in-line wire crimp connectors with the structural reinforcement material conforming to the shape of the portions of the first and second in-line wire crimp connectors;

whereby the compact high voltage electrical fuse reinforcement material contains arc energy when the fuse element opens to break the circuit path under a direct current electrical load at a voltage 50% greater than the predetermined direct current voltage rating of the electrical fuse.

12. The method of claim 11, wherein the predetermined direct current voltage rating is about 1000 VDC.

13. The method of claim 11, wherein attaching the first and second in-line wire crimp connectors comprises friction fitting the first and second in-line wire crimp connectors to the respective first and second ferrule terminal elements of the electrical fuse.

14. The method of claim 11, wherein the cylindrical fuse body of the electrical fuse is fabricated from ceramic.

15. The method of claim 11, further comprising extending an arc absorbing material between the structural reinforcement material and the cylindrical fuse body, between the structural reinforcement material and a portion of the first and second ferrule terminal elements, and between the structural reinforcement material and portions of the first and second in-line wire crimp connectors.

16. The method of claim 15, wherein extending the arc absorbing material comprises extending one of silicone or resinous fluorine-containing polymer material tape.

17. The method of claim 11, wherein covering the body and a portion of the first and second ferrule terminal elements with the structural reinforcement material while incompletely covering portions of the first and second in-line wire crimp connectors with the structural reinforcement material comprises applying a heat shrink material.

18. The method of claim 17, wherein applying the heat shrink material comprises applying an adhesive heat shrink material.

19. The method of claim 18, further comprising applying a color coding to the structural reinforcement material.

20. The method of claim 19, further comprising providing a fuse accessory, and color coding the fuse accessory to match the color coding of the structural reinforcement material.

21. The method of claim 11, wherein the electrical fuse has a current rating of 1 to 20 Amps.

22. The compact high voltage electrical fuse assembly of claim 1, wherein the electrical fuse has a current rating of 1 to 20 Amps.

23. A compact in-line electrical fuse assembly for a 1500 VDC power system, the in-line fuse assembly comprising:

an electrical fuse having a voltage rating of 1000 VDC , the electrical fuse comprising:

a cylindrical fuse body having first and second ends opposing one another;

a first ferrule terminal coupled to the first end of the cylindrical fuse body;

a second ferrule terminal coupled to the second end of the cylindrical fuse body;

a fuse element establishing a circuit path inside the cylindrical fuse body between the first ferrule terminal and the second ferrule terminal;

a first in-line wire crimp terminal coupled to an exterior of the first ferrule terminal;

a second in-line wire crimp terminal coupled to an exterior of the second ferrule terminal; and a structural reinforcement material applied to and conforming with an exterior shape of the in-line electrical fuse assembly, the structural reinforcement material being sufficient to contain arc flash energy and prevent release of arc flash energy when the fuse element opens under a current load in the 1500 VDC power system, wherein the structural reinforcement material is applied to:

entirely cover and structurally reinforce an exterior of the cylindrical fuse body with the structural reinforcement material:

entirely cover and structurally reinforce any exposed exterior of each of the first and second ferrule terminals that are not already covered by the first or second in-line wire crimp terminal with the structural reinforcement material; and incompletely covering and structurally reinforcing only a portion an exterior of each respective on of the first and second in-line wire crimp terminals with the structural reinforcement material.

24. The in-line electrical fuse assembly of claim 23, wherein the fuse is a 10×38 mm photovoltaic fuse.

25. The in-line electrical fuse assembly of claim 23, wherein the structural reinforcement material is a heat shrink material.

* * * * *